US007789223B2

(12) United States Patent
Tokarski et al.

(10) Patent No.: US 7,789,223 B2
(45) Date of Patent: Sep. 7, 2010

(54) INTERCONNECTING CONTACT LENS PACKAGE

(76) Inventors: Michael Tokarski, 500 N. Lakewood Run, Ponte Vedra, FL (US) 32082; James Peck, 13587 Osprey Point, Jacksonville, FL (US) 32224; Edward Dzwill, 9 Blossom La., Flemington, NJ (US) 08822; George Brock, 919 Garrison Dr., St. Augustine, FL (US) 32092; Roger W. Smith, 4351 Harrisburg Pike, Grove City, OH (US) 43123; James R. Davis, 106 Wagnalls Ct., Pickerington, OH (US) 43147

( * ) Notice: Subject to any disclaimer, the term of this patent is extended or adjusted under 35 U.S.C. 154(b) by 789 days.

(21) Appl. No.: 11/561,734

(22) Filed: Nov. 20, 2006
(Under 37 CFR 1.47)

(65) Prior Publication Data

US 2007/0199936 A1 Aug. 30, 2007

Related U.S. Application Data

(63) Continuation of application No. 11/390,639, filed on Mar. 28, 2006, now abandoned.

(60) Provisional application No. 60/666,796, filed on Mar. 31, 2005.

(51) Int. Cl.
*A45C 11/041* (2006.01)

(52) U.S. Cl. ..... 206/5.1

(58) Field of Classification Search ..... 206/5.1, 206/6, 5; 351/155
See application file for complete search history.

(56) References Cited

U.S. PATENT DOCUMENTS

| | | | | | |
|---|---|---|---|---|---|
| 289,923 | A | * | 12/1883 | Hoogesteger | 83/177 |
| 3,768,633 | A | * | 10/1973 | Nathan | 206/5 |
| 3,955,726 | A | | 5/1976 | Reitzel et al. | |
| 5,224,593 | A | * | 7/1993 | Bennett | 206/5.1 |
| 5,383,550 | A | * | 1/1995 | Tsao | 206/5.1 |
| 5,433,314 | A | | 7/1995 | Lin et al. | |

FOREIGN PATENT DOCUMENTS

WO WO 98/21995 5/1998

OTHER PUBLICATIONS

PCT International Search Report, dated Aug. 8, 2006, for PCT Int'l. Appln. No. PCT/US2006/011438.

* cited by examiner

*Primary Examiner*—Ehud Gartenberg
*Assistant Examiner*—Rishi Verma

(57) ABSTRACT

A contact lens package has a body with a lens receptacle therein covered by a hinged lid. The lid is offset on the body such that a ledge is formed by the base and an overhang by the lid. The ledge has a plurality of upstanding lugs that insert into mating receptacles formed in the overhang of an adjacent contact lens package, permitting the ganging of packages together for functional and aesthetic reasons.

13 Claims, 3 Drawing Sheets

INTERCONNECTING CONTACT LENS PACKAGE

RELATED APPLICATIONS

This application is a continuation of U.S. Ser. No. 11/390,639, filed Mar. 28, 2006, which is a non-provisional filing of U.S. Ser. No. 60/666,796, filed on Mar. 31, 2005.

FIELD OF THE INVENTION

The present invention relates to contact lens packages and, more particularly, to such packages that are stored and displayed in groups.

BACKGROUND OF THE INVENTION

Contact lenses have become increasingly popular and due to reductions in manufacturing costs, disposable contact lenses are now an attractive, economical choice for the consuming public. Such lenses may be frequently replaced by consumers (e.g., on a daily or weekly basis) and do not need to be cleaned or sterilized as often as traditional contact lenses. Of course, the consumer must keep a supply of lenses on hand that is commensurate with the frequency with which the lenses are replaced. Consumer demand for disposable contact lenses has led to a need for disposable packaging that is easy to use and inexpensive. The packages should be constructed to provide safe storage and shipping for the lenses, yet provide ready access to the lenses when they are needed by the consumer. It is also desirable that the individual packages be as small as possible, so that they may be easily stored and carried.

Soft contact lenses are typically packaged and stored in a storage solution. One widely-used contact lens package is the "blister pack," which has a rigid plastic container with a flat upper surface and a concave-shaped well that contains a single contact lens with a quantity of storage solution. The lens is retained in the well by a cover sealed along the perimeter of the upper surface of the well. The blister packs are boxed for shipping and storage. When a lens is needed, the consumer peels back the flexible cover from the blister pack to expose the contact lens, pours the lens out into his or her hand, and places the lens on the tip of the finger for application to the eye. It remains an objective to improve contact lens packages to make them easier to use, store and display.

SUMMARY OF THE INVENTION

The disadvantages and shortcomings of the prior art contact lens packages are overcome in accordance with the present invention by providing a new and improved contact lens package which can be conjoined with at least one other contact lens package to form a "ganged" grouping of packages. More particularly, the contact lens package of the present invention includes a base having a lens receptacle therein and a lid for covering and sealing the lens receptacle. The configuration of the base and the lid define a base ledge having lugs that upwardly extend from a top surface of the ledge and a lid overhang having lug receptacles formed in a surface thereof, each of the lug receptacles being adapted to receive a lug of another similar or dissimilar contact lens package. The configuration of the contact lens package allows it to be interconnected with at least two other contact lens packages, thereby allowing a "ganged" grouping of interconnecting packages for storage and retail display.

Specifically, the contact lens package has been adapted for use in housing a single contact lens and an amount of contact lens solution. However, the contact lens package can be utilized to house a plurality of contact lenses and contact lens solution therefor. Further features and advantages of the invention will appear more clearly on a reading of the detailed description of an exemplary embodiment of the invention, which is given below by way of example only with reference to the accompanying drawings.

BRIEF DESCRIPTION OF THE FIGURES

For a more complete understanding of the present invention, reference is made to the following detailed description of an exemplary embodiment considered in conjunction with the accompanying drawings, in which.

DETAILED DESCRIPTION OF THE INVENTION

Figure 1:
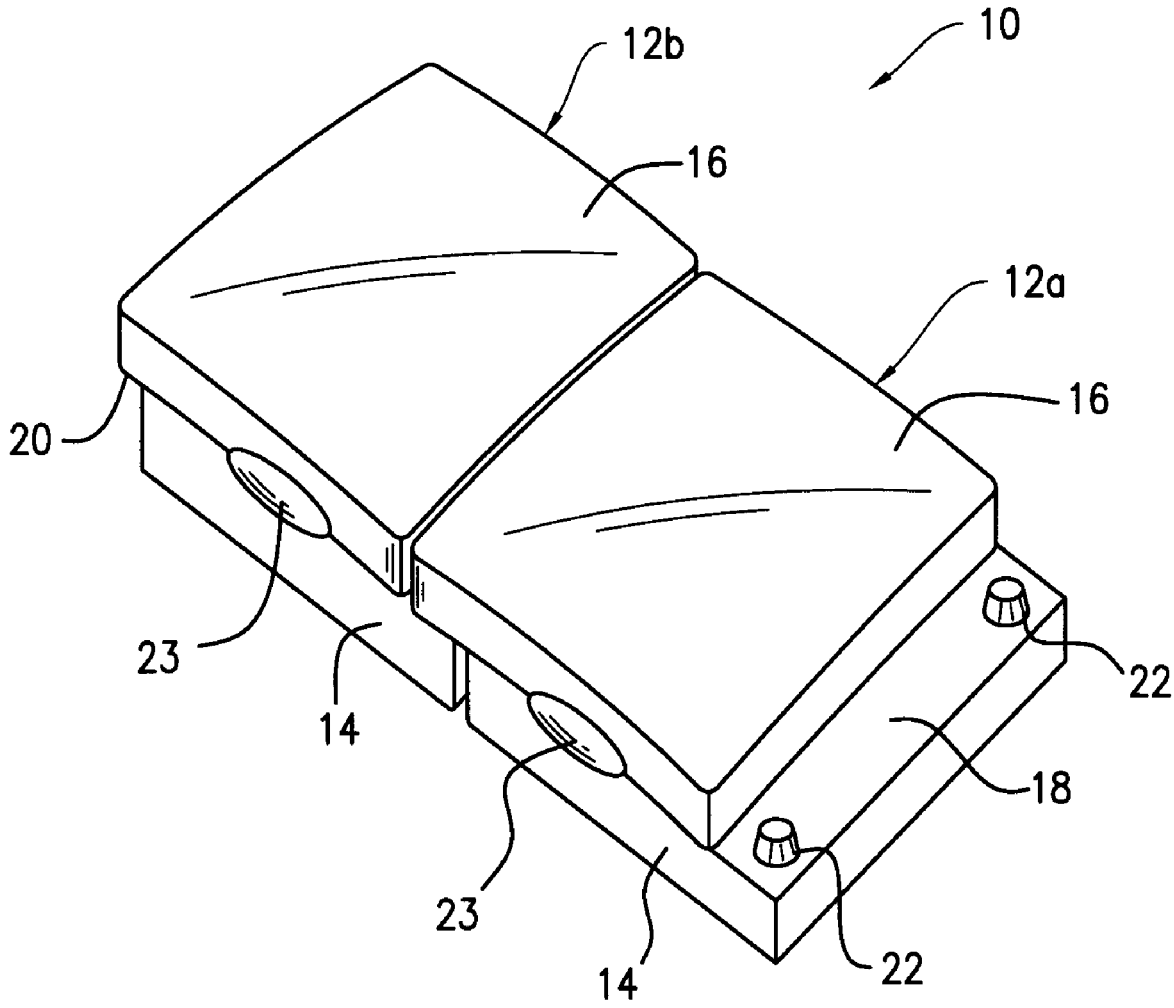
FIG. 1 is a perspective view of a pair of conjoined contact lens packages in accordance with an exemplary embodiment of the present invention.

FIG. 1 shows an array or "ganged" grouping 10 of contact lens packages 12*a*, 12*b*. Each of the contact lens packages 12*a*, 12*b* has a square-shaped base 14 and a square-shaped lid 16. The base 14 and the lid 16 are laterally off-set with each other and define a rectangular-shaped base ledge 18 and a rectangular-shaped lid overhang 20. A pair of conical-shaped lugs 22 extends upwardly from the base ledge 18 of each of the contact lens packages 12*a*, 12*b*. Each of the packages 12*a*, 12*b* has indentations 23 for receiving the fingers of a user to aid in opening the lid 16 from a closed position relative to the base 14.

Figure 2:
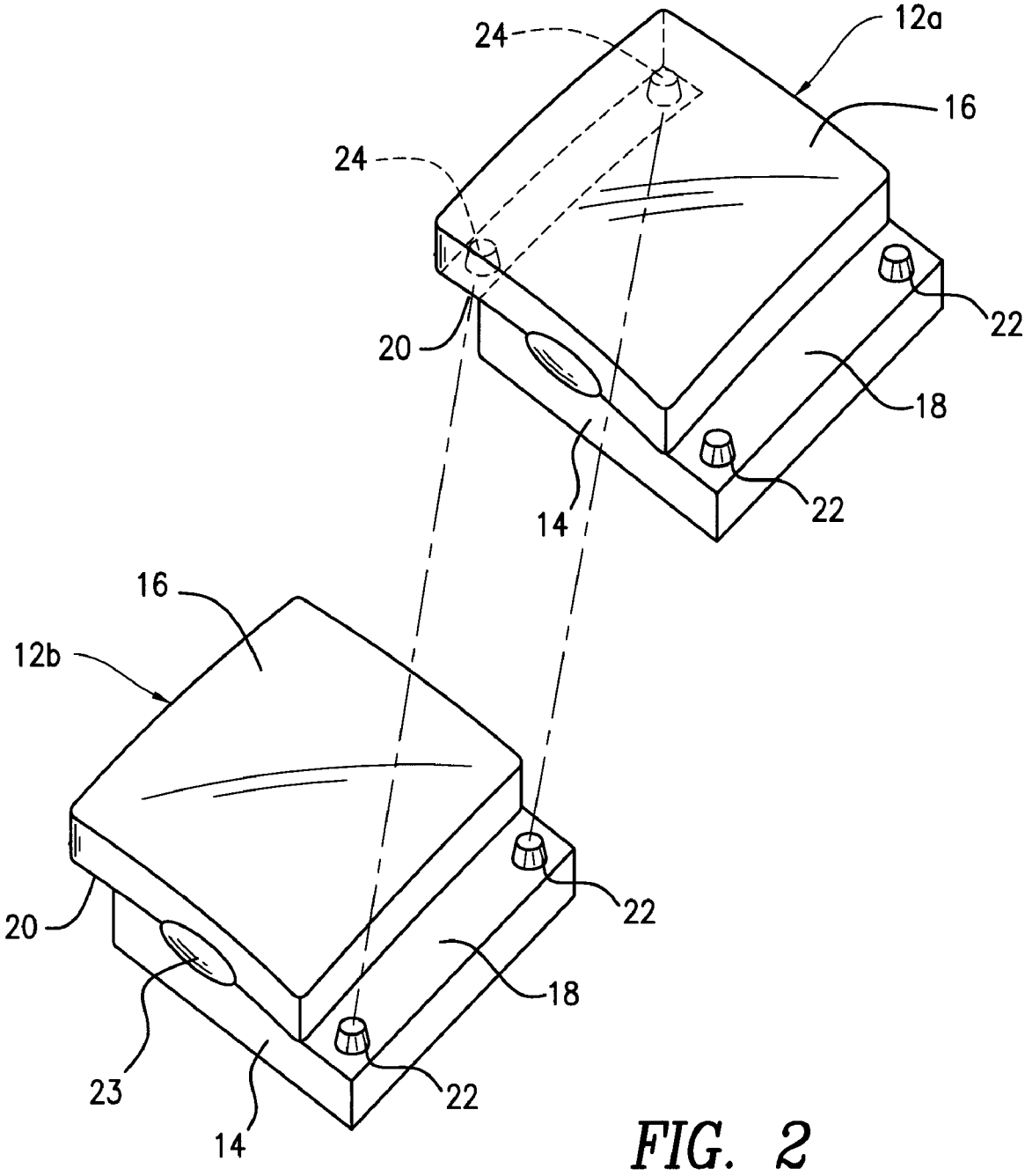
FIGS. 2 and 3 are exploded views of the contact lens packages of FIG. 1.
Figure 3:
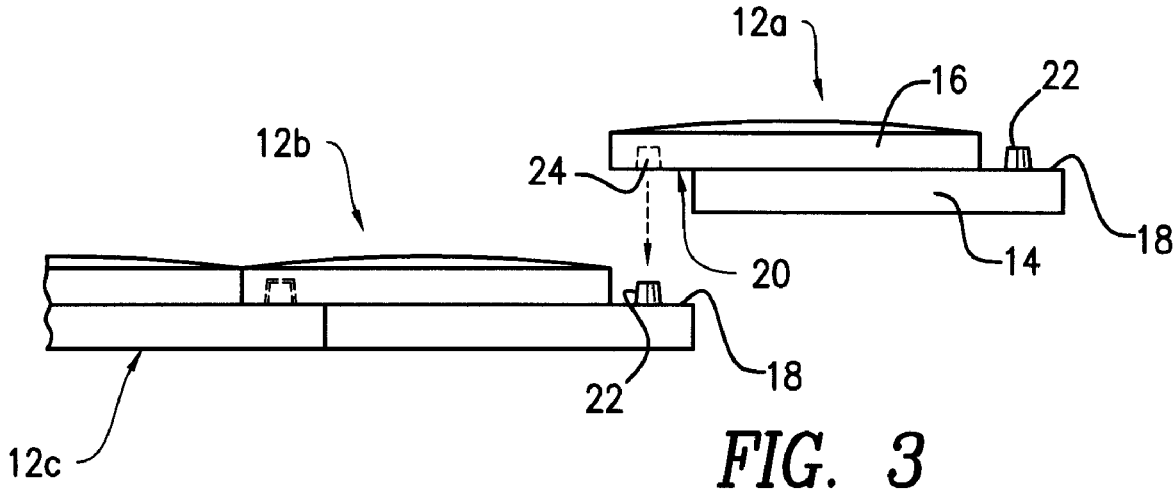

As shown in FIGS. 2 and 3, the lid overhang 20 of each of the contact lens packages 12*a*, 12*b* has a pair of conical-shaped lug receptacles 24 each of which receives a corresponding one of the lugs 22 extending from the base ledge 18 of another of the contact lens packages 12*a*, 12*b*. In this manner, for instance, the packages 12*a*, 12*b* can be conjoined side-by-side with the lid overhang 20 of the package 12*a* extending over the base ledge 18 of the adjacent contact lens package 12*b*, while the package 12*b* and a package 12*c* can be conjoined side-by-side with the lid overhang 20 of the package 12*b* extending over the base ledge 18 of the adjacent contact lens package 12*c*, and so on (see FIG. 3). It should be appreciated that the conjoined adjacent contact lens packages 12*a*, 12*b*, 12*c* "nest" in that the void defined by the base ledge 18 relative to the upper surface of the lid 16 accepts the lid overhang 20 such that the overall thickness or height of the conjoined packages 12*a*, 12*b*, 12*c* does not exceed that of a single package (see FIG. 3). If the lugs 22 and the lug receptacles 24 are positioned as shown, the depth (measured from front to back) of the conjoined packages 12*a*, 12*b*, 12*c* also does not exceed that of a single package.

The adjacent contact lens packages 12*a*, 12*b* are retained in conjunction by virtue of a snap or friction fit established between the lugs 22 and the lug receptacles 24. The lugs 22 may be singular or plural and, preferably, there is one-to-one correspondence of the receptacles 24 to the lugs 22. Preferably, the relative dimensions of the lugs 22 and receptacles 24 are such that the force to connect and disconnect the contact lens packages 12*a*, 12*b* is readily accomplished by the unaided hand of a consumer. As can be appreciated by reviewing FIG. 3, a hand or finger placed upon the contact tens package 12*b* would facilitate the removal of the contact lens package 12*a* therefrom, and a hand or finger placed upon the contact lens package 12*c* would facilitate removal of the contact lens package 12*b* therefrom, and so on.

Figure 4:
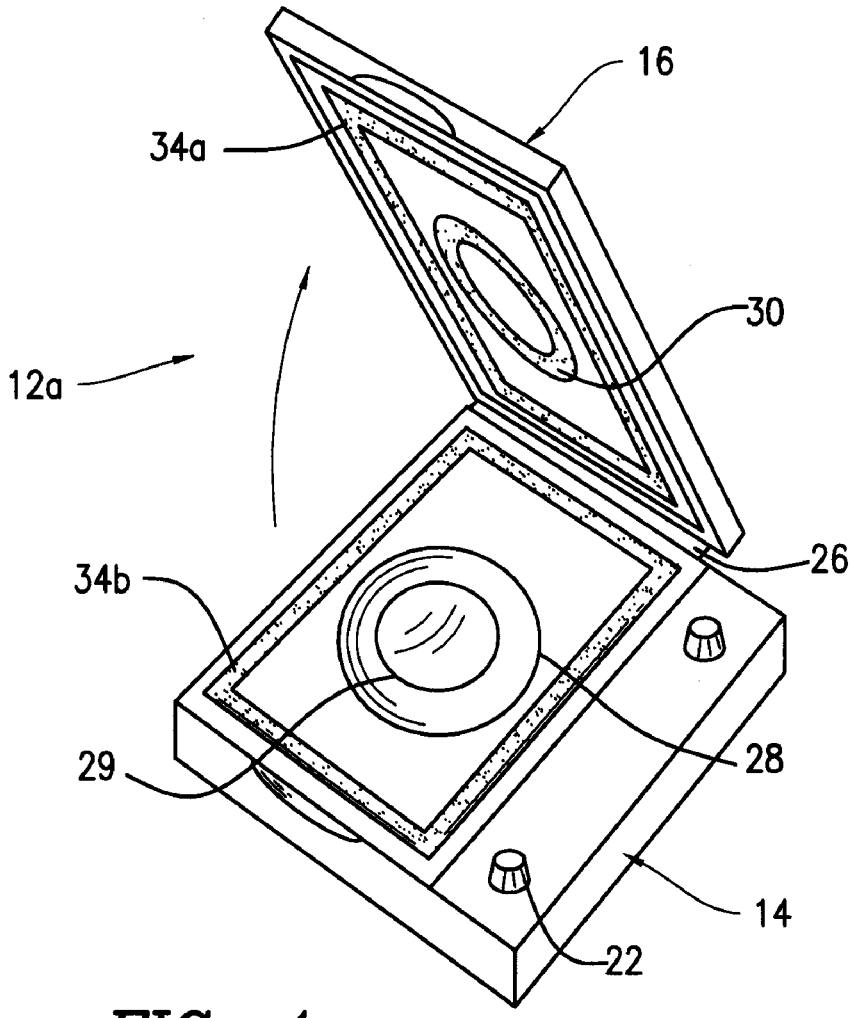
FIG. 4 is a perspective view of one of the contact lens packages shown in FIGS. 1-3 with a lid employed by the package in an open position.

FIG. 4 shows the contact lens package 12*a* with the lid 16 in an open position. Preferably, the lid 16 and the base 14 are conjoined by a hinge 26, e.g., an integral plastic or "living" hinge. The base 14 has a circular-shaped lens well 28 therein for containing a contact lens 29 and any storage or wetting solution (e.g., saline solution) that is required. The lens well 28 is sealed by a circular-shaped well seal 30 which peripherally surrounds the well 28 and establishes a water-tight seal between the lid 16 and the base 14 when the lid 16 is in its closed position. The well seal 30 may be formed by a sealant, an elastomer, a deformable ring monolithically formed with the base 14 or the lid 16, or any other conventional mechanism. Additional water-tight seals 34*a*, 34*b* may be provided proximate to the periphery of the lid 16. The additional seals 34*a*, 34*b* may also be utilized to evidence tampering and thus warn the consumer that any of the packages 12*a*, 12*b* had been opened previously. It is preferred that the contact lens packages 12*a*, 12*b* in accordance with the present invention be made from plastic by injection molding, blow molding or other conventional processes for making plastic packaging.

While the base 14 and the lid 16 are each, preferably, square in shape, it should be noted that each can consist of other shapes and sizes. In addition, while the base ledge 18 and the overhang 20 are each, preferably, rectangular in shape, each can consist of other shapes and sizes. Also, each of the lugs 22 and each of the lug receptacles 24 are, preferably, conical in shape, but each can consist of other shapes and sizes. In addition, each of the lens well 28 and the well seal 30 are, preferably, circular in shape, but each can consist of other shapes and sizes.

As can be appreciated from the foregoing, the present invention permits the physical grouping of the contact lens packages 12*a*, 12*b* in accordance with a logical plan, for example, to connect all contact lens packages holding contact lenses of a particular prescription strength together in one row (i.e., in seriatim fashion). Alternatively, the present invention may be utilized to connect the packages 12*a*, 12*b* into groups for aesthetic or consumer presentation purposes, for example, to retain the contact lens packages 12*a*, 12*b* in orderly rows such that the display is aesthetically pleasing and facilitates the consumer to rapidly select the particular contact lens strength that they require.

It should be understood that the embodiment described herein is merely exemplary and that a person skilled in the art may make many variations and modifications without departing from the spirit and scope of the invention as defined in the appended claims. All such variations and modifications are intended to be included within the scope of the present invention as defined in the appended claims.

We claim:

1. A contact lens package, comprising a body having a lens receptacle therein; first connector and a second connector on said body releasably connecting said contact lens package to another contact lens packages, a lid for at least partially covering said lens receptacle and removably storing a contact lens within said lens receptacle wherein said lid is off-set from said body with said body extending beyond said lid and forming a ledge, said ledge supporting said first connector wherein said lid overhangs said body distal to said ledge, said overhang supporting said second connector.

2. The contact lens package of claim 1, wherein said first connector includes at least one lug extending up from a surface of said ledge.

3. The contact lens package of claim 2, wherein said second connector includes at least one receptacle formed in a surface of said overhang, each receptacle being configured for matingly receiving a corresponding lug of another identical contact lens package.

4. The contact lens package of claim 3, wherein said first connector of said first contact lens package inserts into said second connector of said another contact lens package when said first contact lens package and said another contact lens package are placed adjacent to one another.

5. The contact lens package of claim 4, wherein said overhang of said first contact lens package is complementary to said ledge of said another contact lens package, such that said first contact lens package and said another contact lens package are substantially parallel when they are connected together.

6. The contact lens package of claim 1, wherein said lid is hingedly connected to said body.

7. The contact lens package of claim 6, wherein said lid is connected to said base by a plastic hinge.

8. The contact lens package of claim 7, further comprising a first seal between said body and said lid proximate to an outer periphery of said receptacle for sealing a contact lens in said receptacle.

9. The contact lens package of claim 8, further comprising a second seal between said body and said lid, said second seal disposed proximate an outer periphery of said lid.

10. The contact lens package of claim 9, wherein said second seal is tamper-evident.

11. The contact lens package of claim 10, wherein said first connector and said second connector are each plural in number.

12. A contact lens package, comprising a body having a lens receptacle formed therein; a lid for at least partially covering said lens receptacle and removably sealing a contact lens within said lens receptacle; a ledge located on a first side of said body; an overhang located on a second side of said body opposite said first side thereof; at least one lug extending up from said ledge; and at least one receptacle formed in said overhang.

13. The contact lens package of claim 12, wherein said receptacle is configured for matingly receiving a lug of a second identical contact lens package, and said lug is configured for matingly receiving a receptacle of a third identical contact lens package.

* * * * *